US012709880B2

(12) United States Patent
Chen et al.

(10) Patent No.: US 12,709,880 B2
(45) Date of Patent: Aug. 18, 2026

(54) FAUCET WITH UTENSIL FLUSHING MECHANISM

(71) Applicant: Zhangzhou Solex Smart Home Co., Ltd., Zhangzhou City (CN)

(72) Inventors: Wenxing Chen, Zhangzhou City (CN); Tangjun Dan, Zhangzhou City (CN); Lihong Hu, Zhangzhou City (CN)

(73) Assignee: Zhangzhou Solex Smart Home Co., Ltd., Zhangzhou City (CN)

( * ) Notice: Subject to any disclaimer, the term of this patent is extended or adjusted under 35 U.S.C. 154(b) by 769 days.

(21) Appl. No.: 17/962,613

(22) Filed: Oct. 10, 2022

(65) Prior Publication Data

US 2023/0121994 A1 Apr. 20, 2023

(30) Foreign Application Priority Data

Oct. 20, 2021 (CN) ..... 202111220131.7
Dec. 29, 2021 (CN) ..... 202111642881.3

(51) Int. Cl.
*E03C 1/04* (2006.01)
*A47L 15/00* (2006.01)
(Continued)

(52) U.S. Cl.
CPC ..... *E03C 1/0405* (2013.01); *A47L 15/0065* (2013.01); *A47L 15/4214* (2013.01);
(Continued)

(58) Field of Classification Search
CPC ..... E03C 1/0405; E03C 2001/00; E03C 2001/04; E03C 1/04; E03C 2001/026;
(Continued)

(56) References Cited

U.S. PATENT DOCUMENTS 2,999,249 A * 9/1961 Logan ..... A61H 35/008 4/615
3,443,753 A * 5/1969 McDonnell ..... E03B 9/20 239/27
(Continued)

FOREIGN PATENT DOCUMENTS

CN 102937199 A 2/2013
CN 204025751 U * 12/2014
(Continued)

OTHER PUBLICATIONS

CN-204025751-U Machine Translation (Year: 2025).*
(Continued)

*Primary Examiner* — David P Angwin
*Assistant Examiner* — William R Klotz
(74) *Attorney, Agent, or Firm* — Cooper Legal Group, LLC

(57) ABSTRACT

A faucet with a utensil flushing mechanism comprises a faucet mechanism, a water inlet mechanism, and the utensil flushing mechanism. The faucet mechanism comprises a tube body and a first water passage disposed at least partially in the tube body. The water inlet mechanism is connected to the first water passage. The utensil flushing mechanism is disposed on the faucet mechanism and comprises a nozzle configured to be in communication with the water inlet mechanism. The utensil flushing mechanism is movably disposed on the tube body, and the nozzle is configured to be controlled to be in different positions through movement of the utensil flushing mechanism.

20 Claims, 14 Drawing Sheets

(51) Int. Cl.
*A47L 15/42* (2006.01)
*E03C 1/02* (2006.01)

(52) U.S. Cl.
CPC ..... *A47L 15/424* (2013.01); *A47L 15/4278* (2013.01); *A47L 15/4293* (2013.01); *A47L 2401/04* (2013.01); *A47L 2501/01* (2013.01); *E03C 2001/026* (2013.01); *E03C 2001/0415* (2013.01)

(58) Field of Classification Search
CPC ..... E03C 2001/0415; A47L 15/0065; A47L 15/4214; A47L 15/424; A47L 15/4278; A47L 15/4293; A47L 2401/04; A47L 2501/01; A61H 36/02; F16K 31/02
USPC ..... 4/678, 675, 620; 137/597
See application file for complete search history.

(56) References Cited

U.S. PATENT DOCUMENTS 3,469,603 A * 9/1969 Nagel ..... E03C 1/0404 137/599.08
8,572,772 B2 * 11/2013 Wolf ..... E03C 1/057 4/678
10,575,705 B2 * 3/2020 Gonzalez ..... A47L 15/0065
2008/0142095 A1 * 6/2008 Van Der Linden ..... B67D 1/06 137/560
2014/0250590 A1 * 9/2014 Keiter ..... E03C 1/055 4/678
2018/0092505 A1 * 4/2018 Simon ..... B05B 9/0403
2018/0353376 A1 * 12/2018 Perrin ..... E03C 1/04
2020/0087899 A1 * 3/2020 Cipriani ..... A47L 15/0086
2022/0186476 A1 * 6/2022 Zhang ..... E03C 1/0404
2022/0339678 A1 * 10/2022 Ding ..... B05B 12/1409

FOREIGN PATENT DOCUMENTS

CN 204553992 U * 8/2015
CN 217310182 U 8/2022
CN 115126047 A 9/2022

OTHER PUBLICATIONS

CN-204553992-U Machine Translation (Year: 2025).*
First Office Action cited in CN202111642881.3, mailed Dec. 30, 2024, 15 pages.

* cited by examiner

FAUCET WITH UTENSIL FLUSHING MECHANISM

RELATED APPLICATIONS

This application claims priority to Chinese patent application number 202111220131.7, filed on Oct. 20, 2021 and Chinese patent application number 202111642881.3, filed on Dec. 29, 2021. Chinese patent application number 202111220131.7 and Chinese patent application number 202111642881.3 are incorporated herein by reference.

FIELD OF THE DISCLOSURE

The present disclosure relates to the technical field of kitchens and toilets, and in particular to a faucet with a utensil flushing mechanism.

BACKGROUND OF THE DISCLOSURE

The traditional faucet only has the function of water discharge. In view of the above shortcomings, some people have proposed a faucet with a utensil washing device, such as follows.

A multifunctional faucet comprises a main pipe. A hose is detachably connected to a water outlet of the main pipe, and a second end of the hose defines a disassembly port. A faucet bracket and a cleaning device are fixedly connected to a side wall of the main pipe. The faucet bracket comprises a faucet water inlet and a faucet water outlet. The cleaning device comprises a cleaning bracket and a rolling tube, and the rolling tube comprises an inner cavity. A rotating shaft is fixedly connected in the inner cavity, one end of the rotating shaft extends out of the rolling tube and is rotatably connected with the cleaning bracket. The cleaning bracket comprises a cleaning water inlet connected with the inner cavity. The rotating shaft is fixedly connected with a paddle, the rolling tube is sleeved with a cleaning sleeve, and a tube wall of the rolling tube comprises a through hole penetrating therethrough. When used as a common faucet, the disassembly port and the faucet water inlet can be detachably connected to each other. When used as a cleaning apparatus, the disassembly port is detachably connected with the cleaning water inlet. The cleaning bracket of the cleaning device is fixedly connected with the main pipe, which occupies a large space.

As another example, a utensil flushing apparatus comprises a drain container comprising a receiving portion, a drain channel in fluid communication with the receiving portion, a water delivery rim in fluid communication with the drain channel and configured for conveying water, a fluid discharge member coupled to the discharge container and comprising a central body movably coupled to the discharge container, a plurality of nozzles coupled to the central body and disposed eccentrically relative to the receiving portion, a trigger coupled to the central body and movable with the central body relative to the discharge container, and a valve coupled to the fluid discharge member in an operable manner and configured to move with the trigger to control flow jets of the plurality of nozzles through the central body. The utensil flushing apparatus is fixed on a kitchen countertop, which is inconvenient to use and has a complicated structure.

BRIEF SUMMARY OF THE DISCLOSURE

The present disclosure provides a faucet with a utensil flushing mechanism to solve the deficiencies in the background.

A first technical solution of the present disclosure to solve the technical problem is as follows. A faucet with a utensil flushing mechanism comprises a faucet mechanism, a water inlet mechanism, and the utensil flushing mechanism. The faucet mechanism comprises a tube body and a first water passage disposed at least partially in the tube body. The water inlet mechanism is connected to the first water passage. The utensil flushing mechanism is disposed on the faucet mechanism and comprises a nozzle configured to be in communication with the water inlet mechanism. The utensil flushing mechanism is movably disposed on the tube body, and the nozzle is configured to be controlled to be in different positions through movement of the utensil flushing mechanism.

In a preferred embodiment, a receiving groove is recessed on an outer peripheral wall of the tube body, and the utensil flushing mechanism is disposed in the receiving groove when in a non-use position.

In a preferred embodiment, a connection between the utensil flushing mechanism and the tube body at least comprises a rotating relationship.

In a preferred embodiment, a receiving groove is recessed on an outer peripheral wall of the tube body, and the utensil flushing mechanism is disposed in the receiving groove when in a non-use position. The utensil flushing mechanism is configured to be rotatably connected to the tube body. A rotation axis of the utensil flushing mechanism is arranged horizontally and is disposed in the receiving groove, and a lower groove wall of the receiving groove is configured to inhibit the movement of the utensil flushing mechanism when in a use position.

In a preferred embodiment, the tube body comprises a housing and a base fixedly connected under the housing. The housing is recessed to form the receiving groove. The base forms the lower groove wall of the receiving groove.

In a preferred embodiment, the utensil flushing mechanism comprises a rotating shaft configured to be rotatably connected to the tube body. A first end face of the rotating shaft is recessed with an axial groove configured to be in communication with the water inlet mechanism along an axial direction of the rotating shaft. The utensil flushing mechanism comprises a cup flushing water passage in communication with the nozzle and the axial groove. The nozzle of the utensil flushing mechanism faces upward when in a use position.

In a preferred embodiment, the tube body comprises a mounting seat located thereon. A pivoting shaft protrudes from the mounting seat. The mounting seat comprises a water inlet groove. A distal end face of the pivoting shaft is recessed with a water outlet groove in communication with the water inlet groove. The pivoting shaft is rotatably disposed in the axial groove. The water outlet groove is in communication with the axial groove.

In a preferred embodiment, the tube body comprises a lug. The lug comprises a pivoting hole. The lug and the mounting seat face each other. A second end of the pivoting shaft is rotatably connected in the pivoting hole of the lug.

In a preferred embodiment, the faucet further comprises a first control valve connected between the water inlet mechanism and the utensil flushing mechanism and configured to at least control an opening and closing of the utensil flushing mechanism. The utensil flushing mechanism comprises a water outlet body and a control switch. The nozzle is disposed on the water outlet body. The nozzle of the utensil flushing mechanism faces upward when in a use position. The control switch is in communication with the first control valve.

In a preferred embodiment, the control switch is a touch switch. A top surface of the utensil flushing mechanism is disposed with the touch switch when in the use position, and the touch switch is controlled by whether a utensil is placed on the utensil flushing mechanism.

In a preferred embodiment, the control switch is a sensing switch. A top surface of the utensil flushing mechanism is disposed with the sensing switch when in the use position, and the sensing switch is controlled by sensing whether a utensil is placed on the utensil flushing mechanism.

In a preferred embodiment, the utensil flushing mechanism further comprises a lower casing and a panel. The water outlet body comprises a rotating shaft configured to be rotatably connected to the tube body. A first end face of the rotating shaft is recessed with an axial groove configured to be in communication with the water inlet mechanism along an axial direction of the rotating shaft. The water outlet body comprises a cup flushing water passage in communication with the axial groove and a through opening in communication with the cup flushing water passage. The through opening is disposed with the nozzle. The water outlet body is fixedly disposed in the lower casing. The panel fixedly covers and is connected to the lower casing. The panel comprises a position-providing opening corresponding to the nozzle and the control switch.

In a preferred embodiment, the water inlet mechanism comprises a cold water passage and a hot water passage, and the utensil flushing mechanism is connected to the cold water passage of the water inlet mechanism. The faucet mechanism comprises a first control valve, the first control valve is in communication with the cold water passage, the hot water passage, and the first water passage, and the first control valve is disposed on the tube body.

In a preferred embodiment, the faucet further comprises a second control valve connected between the water inlet mechanism and the utensil flushing mechanism and configured to at least control an opening and closing of the utensil flushing mechanism. The faucet mechanism comprises a supporting pipe and a second water passage. A first end of the first water passage is in communication with the first control valve, and a second end of the first water passage passes through the tube body and the supporting pipe. The first control valve is in communication with the cold water passage and a first end of the second water passage, and a second end of the second water passage is configured to be in communication with the nozzle.

In a preferred embodiment, the second water passage is disposed with an ozone generator.

In a preferred embodiment, the nozzle is configured to be controlled to face upward or downward through the movement of the utensil flushing mechanism.

A second technical solution of the present disclosure to solve the technical problem is as follows. A faucet with a utensil flushing mechanism comprises a faucet mechanism, a water inlet mechanism, the utensil flushing mechanism. The faucet mechanism comprises a tube body and a first water passage disposed at least partially in the tube body. The water inlet mechanism is connected to the first water passage. The utensil flushing mechanism is movably disposed on the tube body and is configured to move relative to the tube body between a use position and a non-use position. A receiving groove is recessed on an outer peripheral wall of the tube body, and the utensil flushing mechanism is disposed in the receiving groove when in the non-use position.

A third technical solution of the present disclosure to solve the technical problem is as follows. A faucet with a utensil flushing mechanism comprises a faucet mechanism, a water inlet mechanism, the utensil flushing mechanism. The faucet mechanism comprises a tube body and a first water passage disposed at least partially in the tube body. The water inlet mechanism is connected to the first water passage. The utensil flushing mechanism comprises a nozzle configured to be in communication with the water inlet mechanism. The utensil flushing mechanism is disposed on the faucet mechanism and is configured to be controlled to be alternatively in a use state or a non-use state. The nozzle of the utensil flushing mechanism is exposed when in the use state, and the nozzle of the utensil flushing mechanism is hidden when in the non-use state.

In a preferred embodiment, the utensil flushing mechanism is movably disposed on the tube body, and the utensil flushing mechanism is configured to move relative to the tube body between a use position and a non-use position.

In a preferred embodiment, the faucet further comprises a cover plate movably connected to the tube body. The cover plate is configured to move relative to the tube body between a cover connection position, at which the cover plate at least covers the nozzle, and an open position, at which the cover plate does not cover the nozzle. The utensil flushing mechanism is configured to be controlled to be alternatively in the use state or the non-use state through movement of the cover plate.

In a preferred embodiment, the cover plate forms a cover connection cavity, the cover plate is rotatably connected to the tube body, and the cover connection cavity of the cover plate covers the nozzle when in the cover connection position.

In a preferred embodiment, the tube body comprises an installation surface, the nozzle is disposed on the installation surface, and the cover plate in the cover connection position covers the installation surface.

In a preferred embodiment, an installation groove is recessed on an outer peripheral wall of the tube body, and the nozzle is disposed in the installation groove. The cover plate is rotatably connected to the tube body. The cover plate covers a groove opening of the installation groove when in the cover connection position.

In a preferred embodiment, the utensil flushing mechanism is fixedly connected to the tube body.

In a preferred embodiment, the faucet further comprises a first control valve connected between the water inlet mechanism and the utensil flushing mechanism and configured to at least control an opening and closing of the utensil flushing mechanism. The utensil flushing mechanism comprises a control switch, and the control switch is in communication with the first control valve. The nozzle faces outward. The cover plate covers the control switch when in the cover connection position.

In a preferred embodiment, the faucet further comprises a control box, and the first control valve is disposed in the control box. The control switch is connected with a signal wire, and the signal wire is in communication with the first control valve.

In a preferred embodiment, the faucet further comprises a cover plate, and the cover plate forms a cover connection cavity. The cover plate is rotatably connected to the tube body. The cover connection cavity of the cover plate covers the nozzle when in a cover connection position.

In a preferred embodiment, the water inlet mechanism comprises a cold water passage and a hot water passage, and the utensil flushing mechanism is connected to the cold water passage of the water inlet mechanism. The faucet mechanism comprises a first control valve in communication with the cold water passage, the hot water passage, and the first water passage, and the first control valve is disposed on the tube body. The faucet further comprises a second control valve connected between the water inlet mechanism and the utensil flushing mechanism to control an opening and closing of the utensil flushing mechanism. The faucet mechanism comprises a supporting pipe and a second water passage. A first end of the first water passage is in communication with the first control valve, and a second end of the first water passage passes through the tube body and the supporting pipe. The second control valve is in communication with the cold water passage and a first end of the second water passage, and a second end of the second water passage is configured to be in communication with the nozzle.

Compared with the existing techniques, the technical solution has the following advantages.

The utensil flushing mechanism is movably disposed on the tube body, and the utensil flushing mechanism can be moved as needed to control the nozzle to be in different positions. The nozzle in the use position faces upward to be used for flushing, and the nozzle in the non-use position faces downward to avoid being damaged and being contaminated to protect the nozzle. The utensil flushing mechanism is moved to control whether the utensil flushing mechanism is in the use state or the non-use state. Since the utensil flushing mechanism can be in two positions, it is convenient to use and store, the occupied space is reduces, and the utensil flushing mechanism has a simple and beautiful appearance.

The utensil flushing mechanism is disposed on the tube body and can be used to control whether the utensil flushing mechanism is in the use state or the non-use state. The nozzle of the utensil flushing mechanism in the use state is exposed, and the nozzle of the utensil flushing mechanism in the non-use state is hidden, which is convenient for use and storage and avoids the nozzle being damaged and contaminated.

The movement of the utensil flushing mechanism is inhibited by the lower groove wall of the receiving groove to limit movement of the utensil flushing mechanism in the use position, thereby improving the stability and convenience during use.

The tube body comprises a housing and a base fixed under the housing. The housing is recessed to form the above-mentioned receiving groove, and the base forms the above-mentioned lower groove wall of the receiving groove, which is convenient for assembly and simple in structure.

The first end face of the rotating shaft is recessed with the axial groove along the axial direction of the rotating shaft that can be connected to the water inlet mechanism, and the utensil flushing mechanism comprises a cup flushing water passage that is connected to the nozzle and the axial groove. Additionally or alternatively, the mounting seat protrudes with a pivoting shaft, and the mounting seat comprises the water inlet groove that can be in communication with the water inlet mechanism. The distal end face of the pivoting shaft is recessed with the water outlet groove in communication with the water inlet groove. The pivoting shaft can be rotated and inserted into the axial groove, and the water outlet groove and the axial groove are connected to each other. The water connection and the rotation of the utensil flushing mechanism do not interfere with each other.

The nozzle of the utensil flushing mechanism is controlled to be exposed or hidden by the cover plate in the open position or the cover connection position. The cover plate is opened when in use, and the cover plate is covered when not in use, so as to hide the nozzle and avoid the nozzle from being damaged and contaminated.

DETAILED DESCRIPTION OF THE EMBODIMENTS

Figure 1:
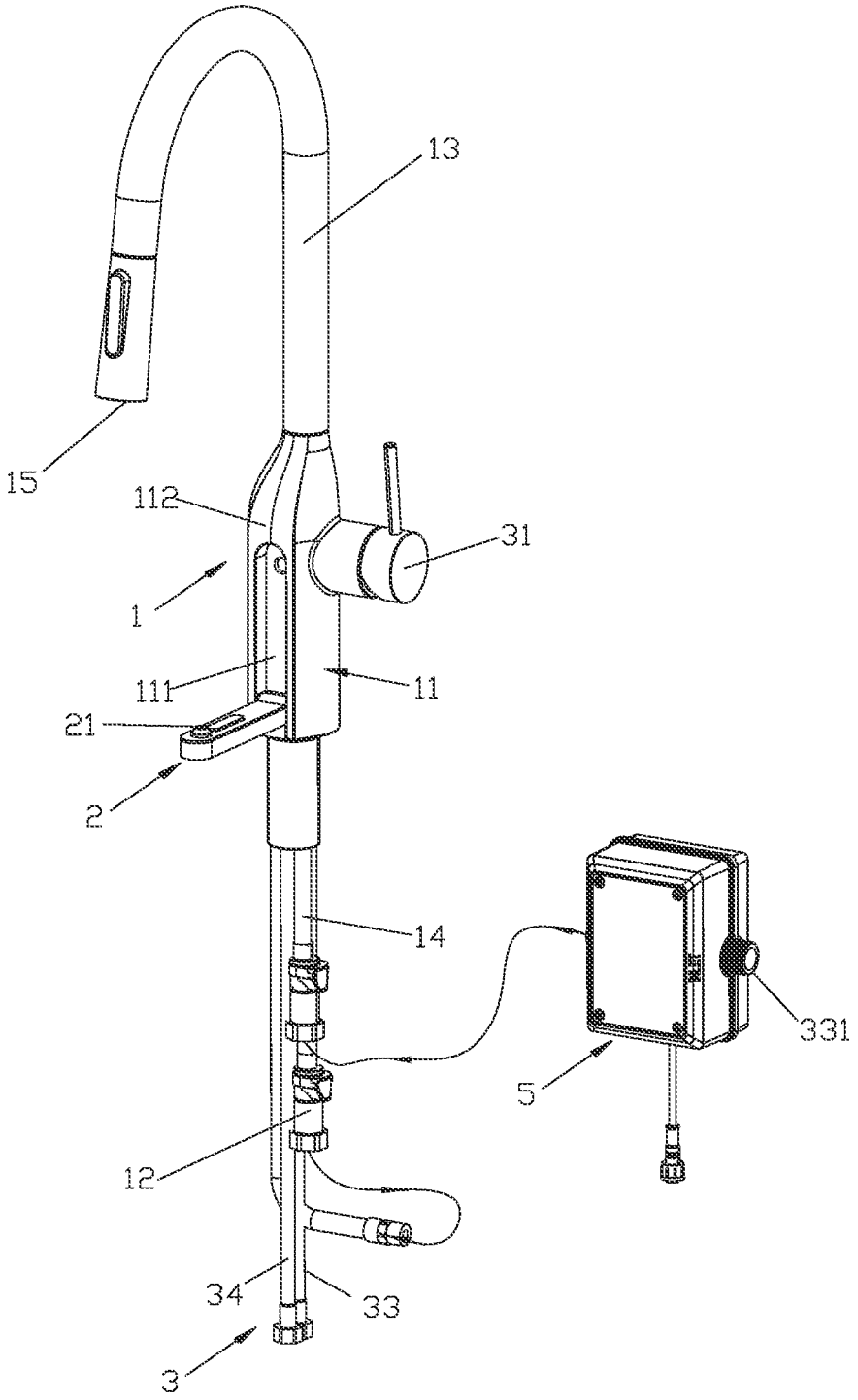
FIG. 1 illustrates a perspective view of a faucet of Embodiment 1, when a utensil flushing mechanism is in a use position.
Figure 2:
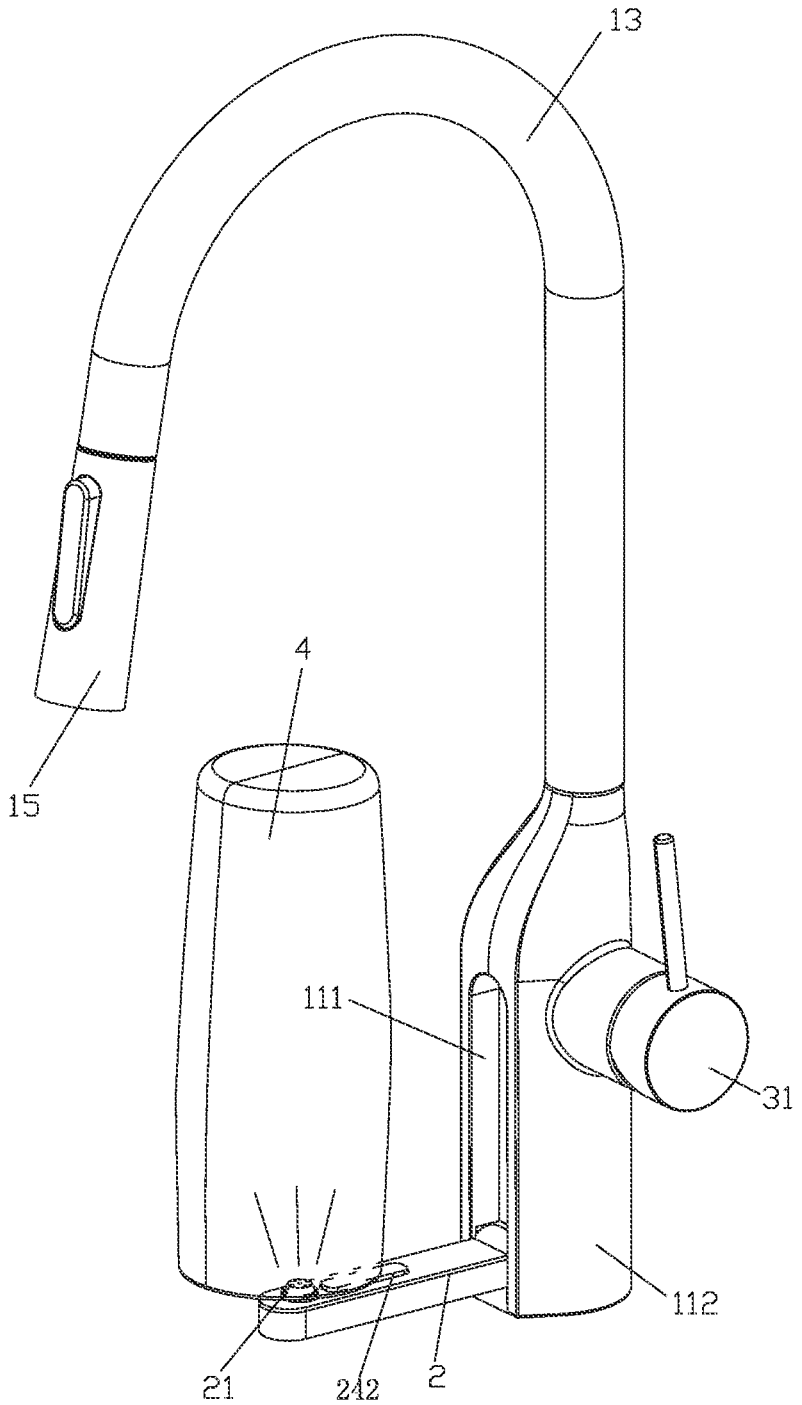
FIG. 2 illustrates a perspective view of a faucet mechanism and the utensil flushing mechanism of Embodiment 1, when a utensil is being flushed.
Figure 3:
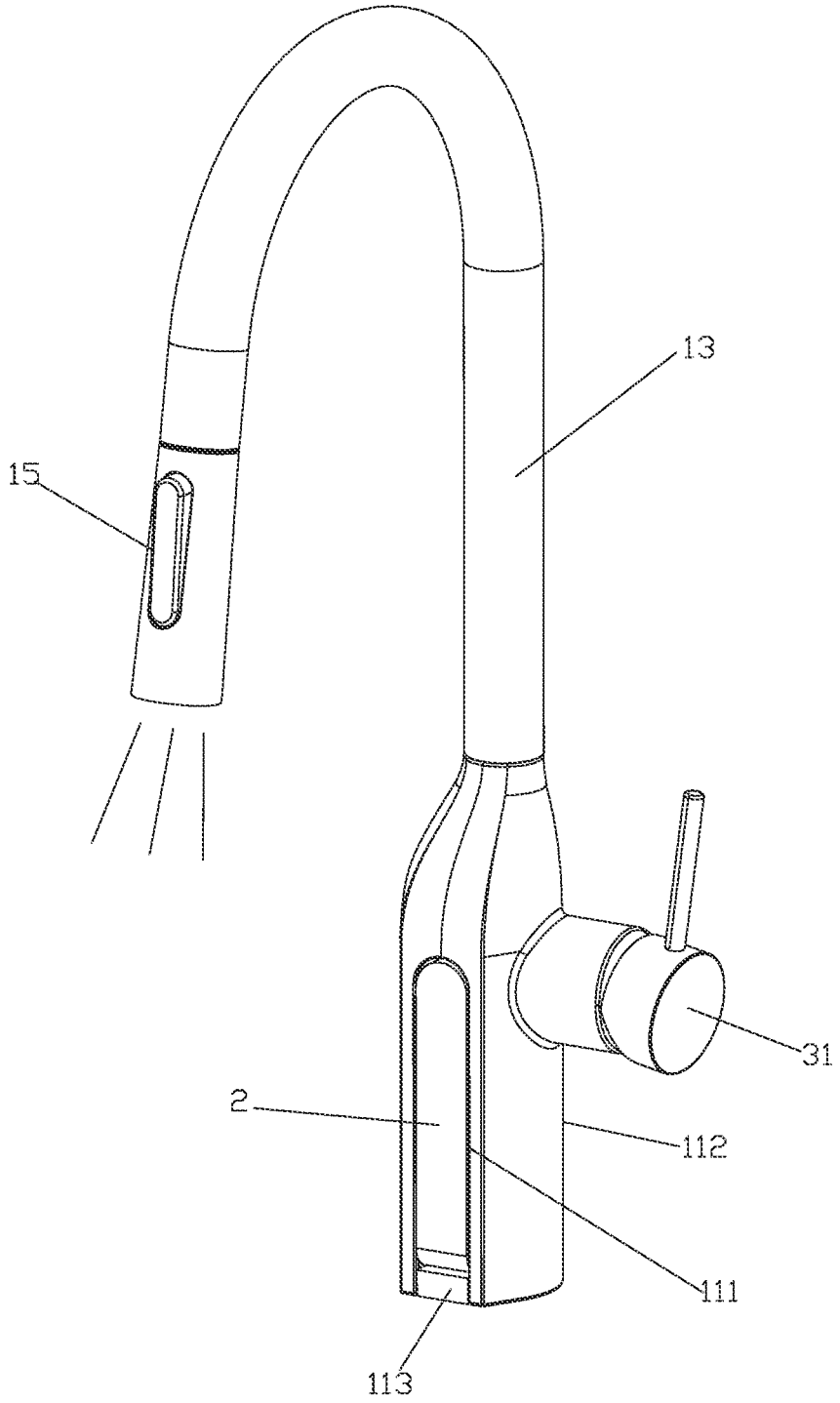
FIG. 3 illustrates a perspective view of the faucet mechanism and the utensil flushing mechanism of Embodiment 1, when the utensil flushing mechanism is in a non-use position.
Figure 4:
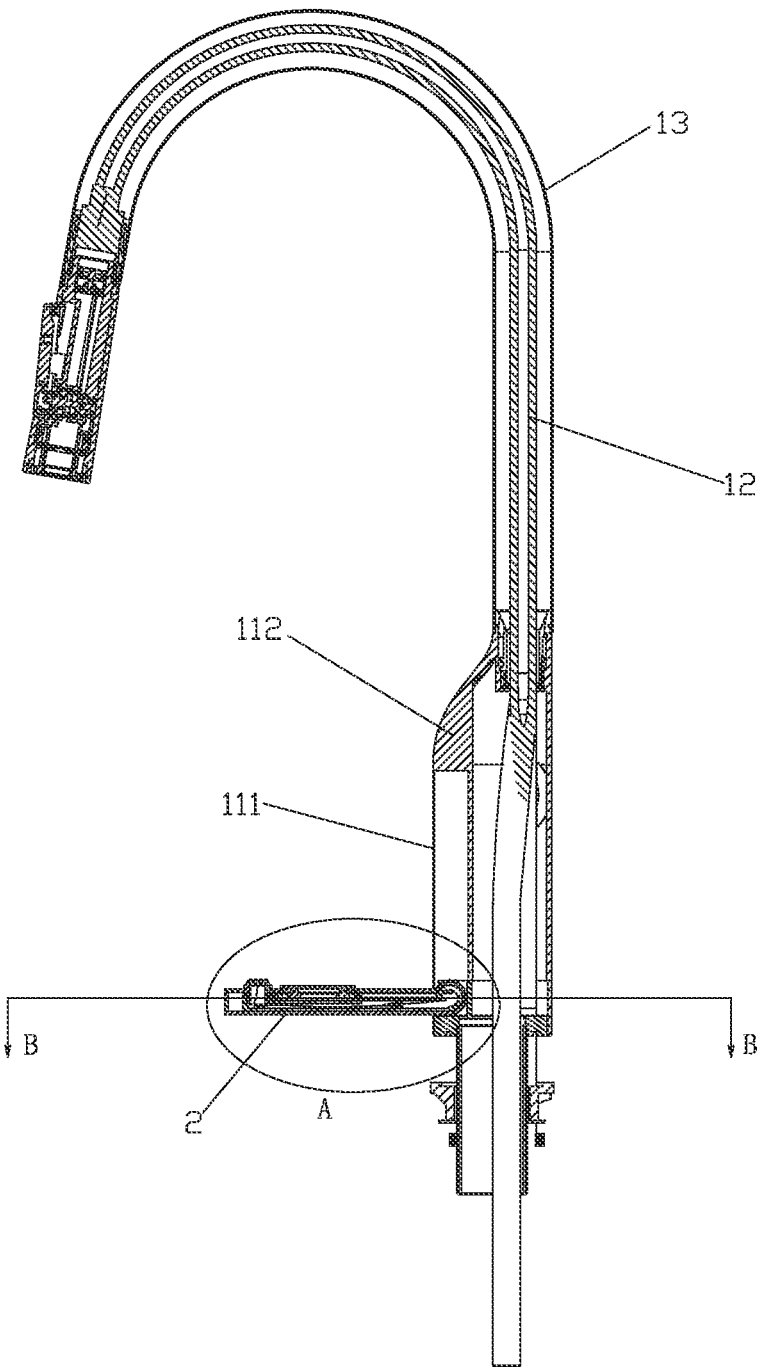
FIG. 4 illustrates a cross-sectional view of the faucet mechanism and the utensil flushing mechanism of Embodiment 1, when the utensil flushing mechanism is in the use position.
Figure 5:
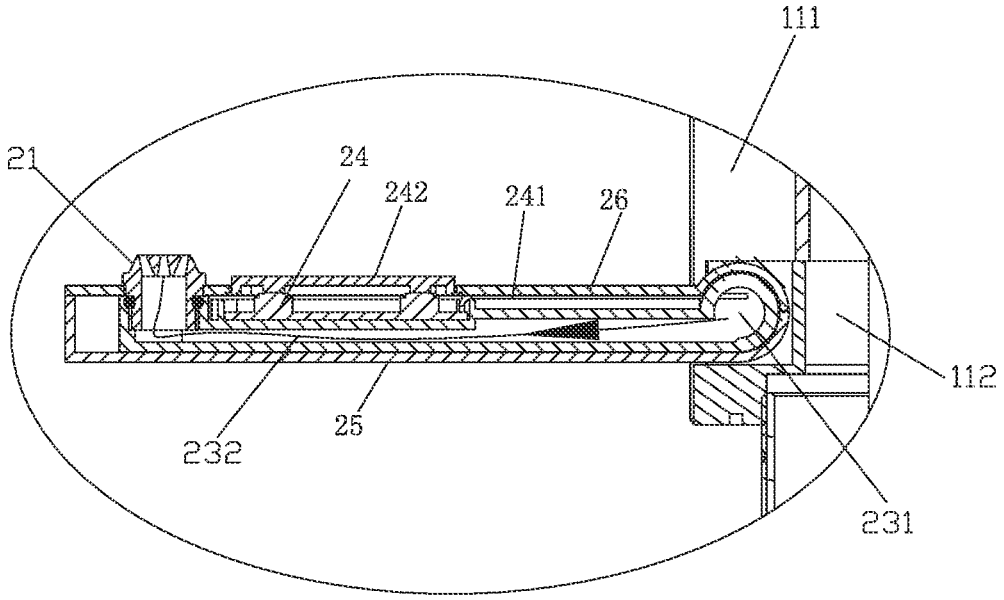
FIG. 5 illustrates an enlarged view of a circle position A in FIG. 4.
Figure 6:
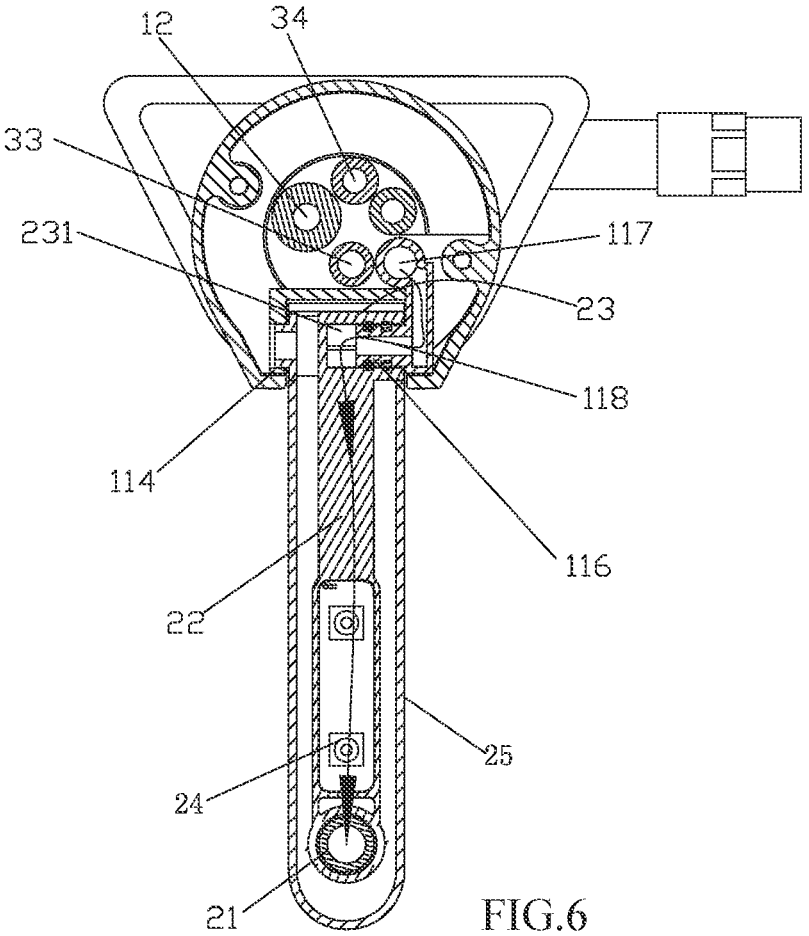
FIG. 6 illustrates a cross-sectional view of a B-B surface in FIG. 4.
Figure 7:
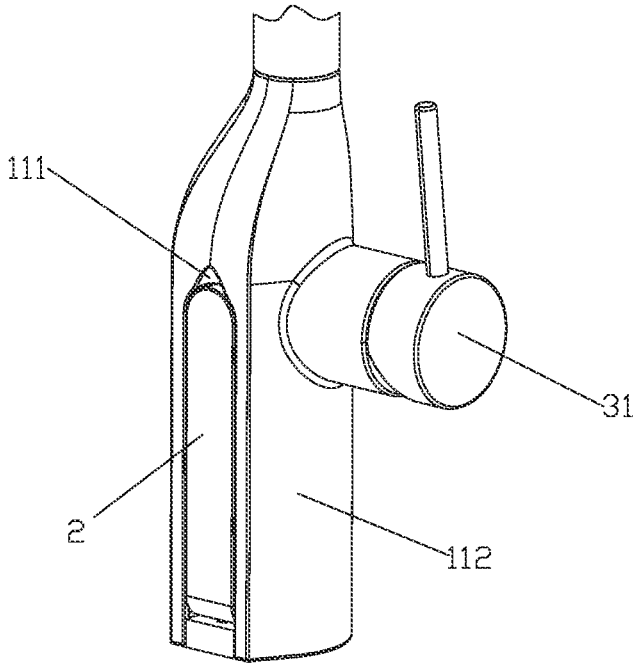
FIG. 7 illustrates a perspective view of a tube body and the utensil flushing mechanism of Embodiment 1, when the utensil flushing mechanism is in the non-use position.
Figure 8:
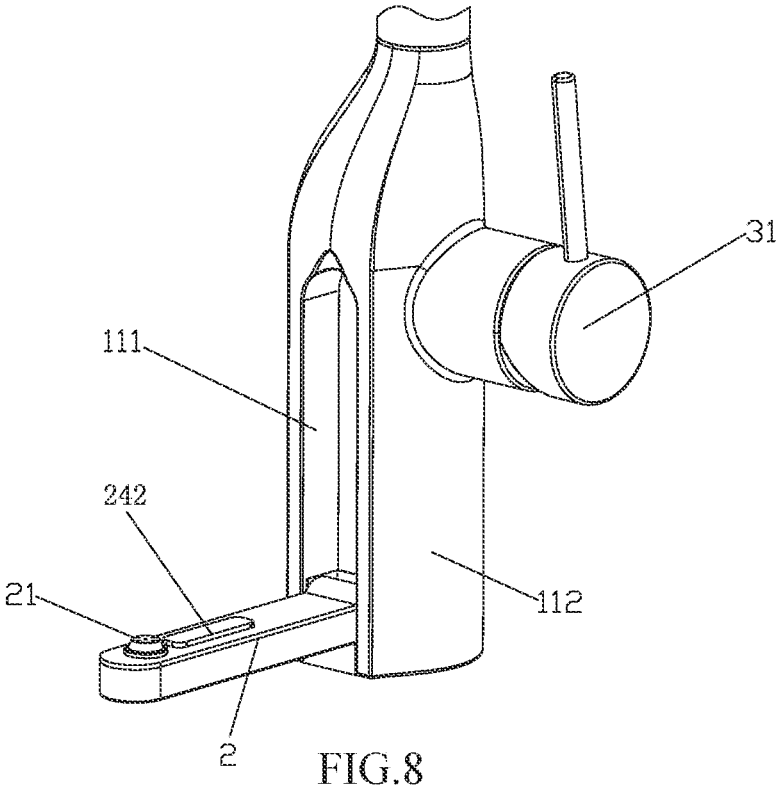
FIG. 8 illustrates a perspective view of the tube body and the utensil flushing mechanism of Embodiment 1, when the utensil flushing mechanism is in the use position.
Figure 9:
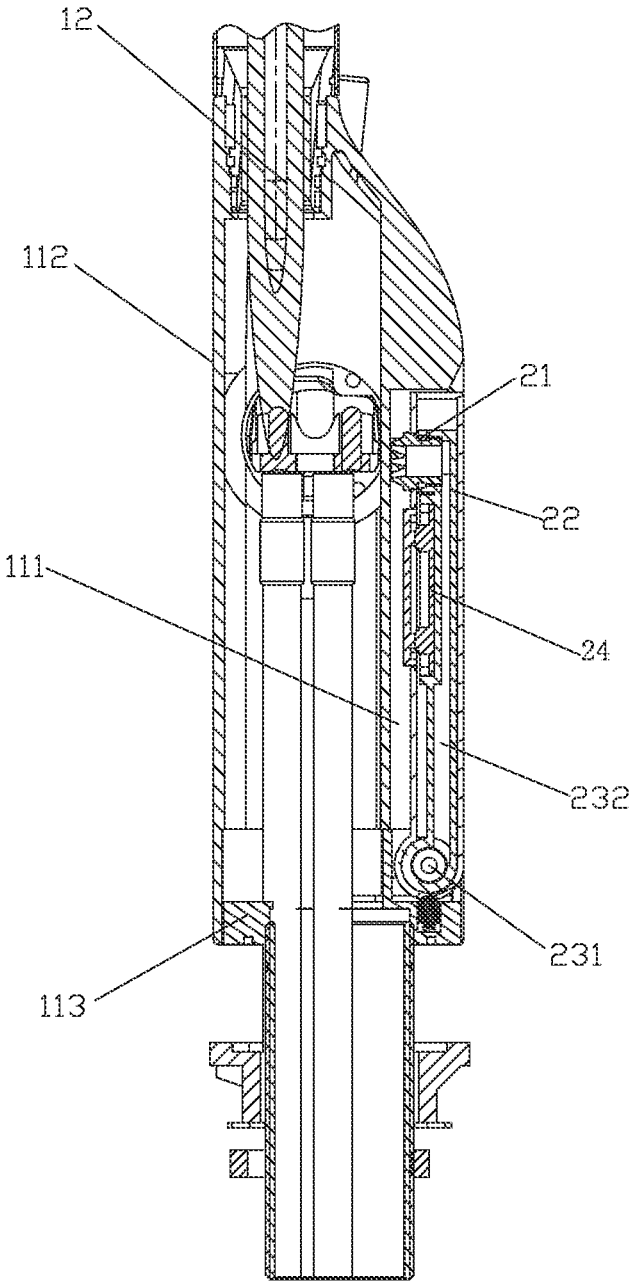
FIG. 9 illustrates a cross-sectional view of the tube body and the utensil flushing mechanism of Embodiment 1.
Figure 10:
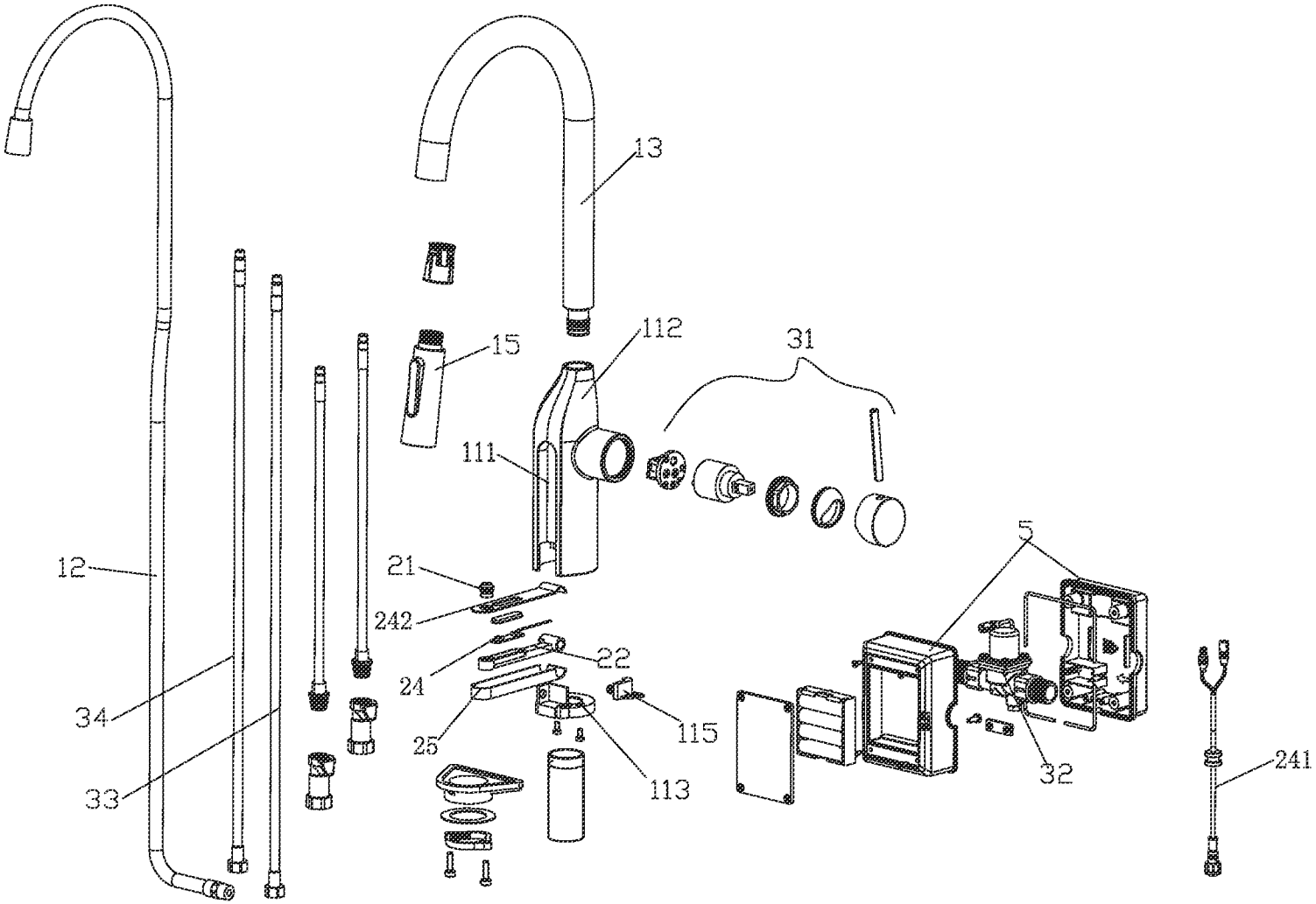
FIG. 10 illustrates a perspective exploded view of the faucet of Embodiment 1.
Figure 11:
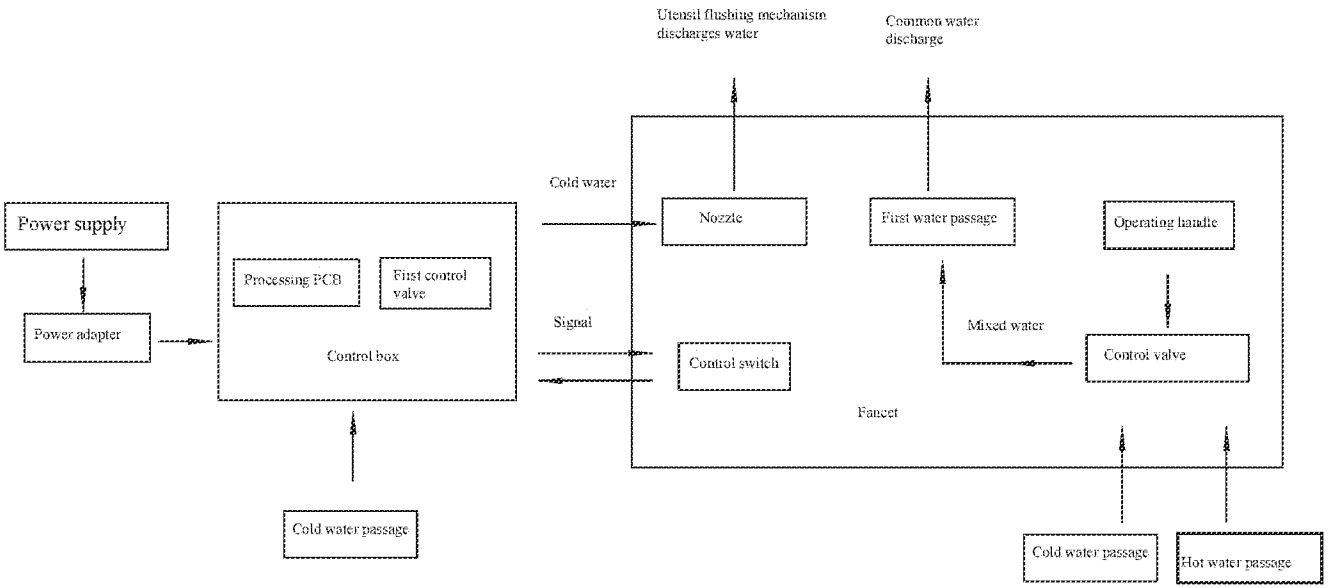
FIG. 11 illustrates a schematic block diagram of the faucet of Embodiment 1.

The present disclosure will be further described below in combination with the accompanying drawings and embodiments.

Embodiment 1

Referring to FIGS. 1 to 11, a faucet with a utensil flushing mechanism comprises a faucet mechanism 1, a utensil flushing mechanism 2, and a water inlet mechanism 3. The faucet mechanism 1 comprises a tube body 11 and a first water passage 12 disposed at least partially in the tube body 11. The water inlet mechanism 3 is connected to the first water passage 12 through a first control valve 31. The utensil flushing mechanism 2 is mounted to the tube body 11 and is configured to be controlled to be alternatively in a use state or a non-use state. A nozzle 21 of the utensil flushing mechanism 2 in the use state is exposed, and the nozzle 21 of the utensil flushing mechanism 2 in the non-use state is hidden. In this embodiment, the utensil flushing mechanism 2 is movably disposed on the tube body 11 and can move relative to the tube body 11 between a use position corresponding to the use state and a non-use position corresponding to the non-use state. The utensil flushing mechanism 2 comprises the nozzle 21. The water inlet mechanism 3 is connected to the nozzle 21 through a second control valve 32. The nozzle 21 of the utensil flushing mechanism 2 in the use position faces upward, and the utensil flushing mechanism 2 movably controls the nozzle 21 to be in the use state or the non-use state. In this specific embodiment, a receiving groove 111 is recessed on an outer peripheral wall of the tube body 11, and the utensil flushing mechanism 2 in the non-use position is located in the receiving groove 111 so that the utensil flushing mechanism 2 is hidden in the tube body 11, which has a compact structure after storage and is simple in appearance. Not only does a user not need to set up a separate installation position on a kitchen countertop for the utensil flushing mechanism 2, but also a space occupied by the faucet is saved. The connection between the utensil flushing mechanism 2 and the tube body 11 at least comprises a rotating relationship. If there is only a rotating connection, a rotation axis of the utensil flushing mechanism 2 is arranged horizontally, and the utensil flushing mechanism 2 is arranged horizontally when the utensil flushing mechanism 2 is in the use position, which is convenient to use. When the utensil flushing mechanism 2 is in the non-use position, the utensil flushing mechanism 2 is vertically stored in the receiving groove 111, which is compact in structure, and the nozzle 21 faces a bottom of the receiving groove 111 to be in a hidden state. There is only a rotating connection, which is easy to operate. In order to facilitate opening the utensil flushing mechanism 2 in the non-use position, an upper groove wall of the receiving groove 111 is formed with a recessed point. In order to improve turning convenience, a positioning mechanism is disposed between the tube body 11 and the utensil flushing mechanism 2 to enable the utensil flushing mechanism 2 to be stably maintained in the use position or the non-use position and to improve the turning feel. In some embodiments, other movable connection structures, such as sliding or pulling, can also be used as needed.

The water inlet mechanism 3 comprises a cold water passage 33 and a hot water passage 34. The faucet mechanism 1 comprises the first control valve 31, a supporting pipe 13, and a second water passage 14. The first control valve 31 is in communication with the cold water passage 33, the hot water passage 34, and the first water passage 12, and the first control valve 31 is mounted on the tube body 11 to be configured to control an opening and closing, a flow rate, and a water temperature of water from the first water passage 12. The structure of the first control valve 31 can be referenced in the prior art. A first end of the first water passage 12 is in communication with the first control valve 31, and a second end of the first water passage 12 passes through the tube body 11 and the supporting pipe 13. The second end of the first water passage 12 is disposed with a water outlet terminal 15, and the first water passage 12 can be a flexible water pipe. The second control valve 32 is connected between the cold water passage 33 of the water inlet mechanism 3 and the utensil flushing mechanism 2 to control an opening and closing of the utensil flushing mechanism 2. The second control valve 32 is, for example, a solenoid valve, and the second control valve 32 is in communication with the cold water passage 33 and a first end of the second water passage 14 through a joint 331. A second end of the second water passage 14 can be in communication with the nozzle 21.

In this specific embodiment, a rotating shaft 23 of the utensil flushing mechanism 2 is disposed in the receiving groove 111, and a lower groove wall of the receiving groove 111 is configured to inhibit movement of the utensil flushing mechanism 2 in the use position. In the specific structure, the tube body 11 comprises a housing 112 and a base 113 fixedly connected under the housing 112. The housing 112 is recessed to form the receiving groove 111, and the base 113 forms the lower groove wall of the receiving groove 111. A lug 114 protrudes from the base 113, and the lug 114 comprises a pivoting hole. The base 113 is disposed with a mounting seat 115, and a fixed relationship is formed between the base 113 and the mounting seat 115. The lug 114 and the mounting seat 115 face each other, and a pivoting shaft 116 facing the lug 114 protrudes from the mounting seat 115. The mounting seat 115 comprises a water inlet groove 117 configured to be in communication with the second water passage 14, and a distal end face of the pivoting shaft 116 is recessed with a water outlet groove 118 in communication with the water inlet groove 117.

The utensil flushing mechanism 2 comprises a water outlet body 22, and a side of the water outlet body 22 comprises the rotating shaft 23. A first end face of the rotating shaft 23 is recessed with an axial groove 231 along an axial direction of the rotating shaft 23. The water outlet body 22 comprises a cup flushing water passage 232 in communication with the axial groove 231 and a through opening in communication with the cup flushing water passage 232, and the through opening is disposed with the nozzle 21. A second end of the rotating shaft 23 is configured to be rotatably connected to the pivoting hole of the lug 114, and the pivoting shaft 116 of the mounting seat 115 is configured to be rotatably inserted into the axial groove 231 of the rotating shaft 23. The rotating shaft 23 is disposed in the receiving groove 111 through the above-mentioned connection, and the water outlet groove 118 is in communication with the axial groove 231, so that a water path is illustrated as below. The cold water passage 33—the second control valve 32—the water inlet groove 117—the water outlet groove 118—the axial groove 231—the cup flushing water passage 232—the nozzle 21.

The utensil flushing mechanism 2 further comprises a control switch 24, and the control switch 24 is in communication with the second control valve 32. The control switch 24 can be a touch switch. A top surface of the utensil flushing mechanism 2 in the use position is disposed with the touch switch, and the touch switch is controlled by whether a utensil 4 is placed on the utensil flushing mechanism 2. Alternatively, the control switch 24 can be a sensing switch. The top surface of the utensil flushing mechanism 2 in the use position is disposed with the sensing switch, and the sensing switch is controlled by sensing whether the utensil 4 is placed on the utensil flushing mechanism 2. The touch switch is a capacitive sensing button, and the sensing switch is an infrared sensor. The control switch 24 enables the utensil flushing mechanism 2 to be automatically controlled by whether the utensil 4 is placed on the utensil flushing mechanism 2. As needed, the control switch 24 that is controlled manually can be set up, such as a manual press operation switch or human body induction. In the specific structure, the utensil flushing mechanism 2 further comprises a lower casing 25 and a panel 26. The water outlet body 22 is fixedly disposed in the lower casing 25, the panel 26 fixedly covers and is connected to the lower casing 25. The panel 26 comprises a position-providing opening corresponding to the nozzle 21 and the control switch 24. The faucet further comprises a control box 5, and the second control valve 32 is disposed in the control box 5. The control switch 24 is connected with a signal wire 241, and the signal wire 241 passes through a gap between the water outlet body 22 and the panel 26 and the tube body 11 to be in communication with the second control valve 32 located in the control box 5, which has a compact structure, a beautiful appearance, and a safe and reliable structure.

A cup flushing process is as follows. 1. When the control switch 24 is the capacitive sensing button, the utensil flushing mechanism 2 is rotated to be in the use position, the utensil 4 (e.g., a cup) is held by hand to be placed on the utensil flushing mechanism 2 and cover the nozzle 21, the capacitive sensing button is touched by the utensil 4 to cause the control switch 24 to be turned on, and the nozzle 21 discharges water to achieve flushing. 2. When the control switch 24 is the infrared sensor, the utensil flushing mechanism 2 is rotated to be in the use position, the utensil 4 (e.g., a cup) is held by hand to be placed on the utensil flushing mechanism 2 and cover the nozzle 21. When the utensil 4 is sensed by the infrared sensor, the first control valve 31 is turned on, and the nozzle 21 discharges water to achieve flushing. 3. The utensil flushing mechanism 2 is rotated to be in the use position, the utensil 4 (e.g., a cup) is held by hand to be placed on the utensil flushing mechanism 2 and cover the nozzle 21, and the control switch 24 is manually operated to enable the nozzle 21 to discharge water to achieve flushing.

Embodiment 2

Figure 12:
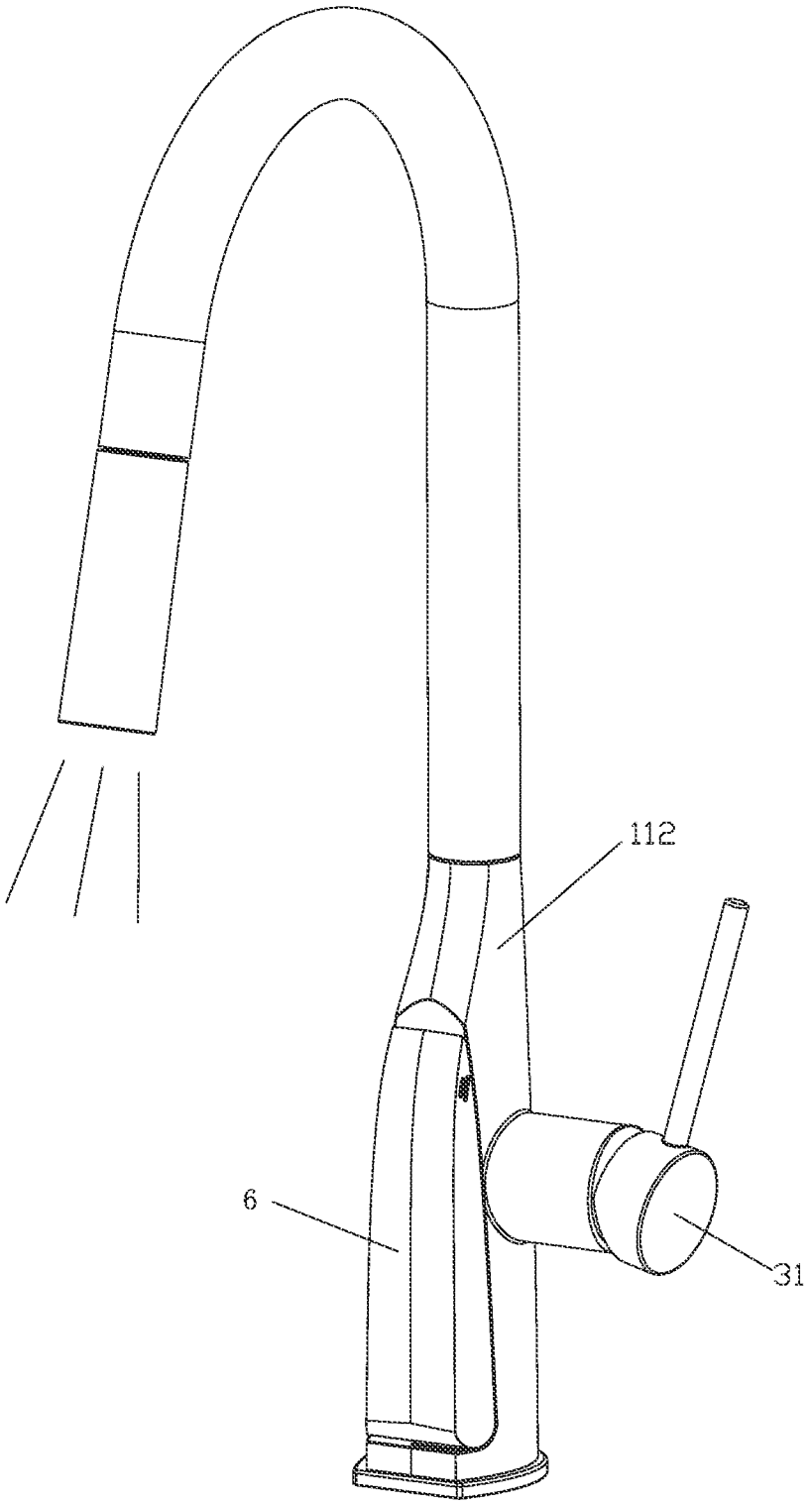
FIG. 12 illustrates a perspective view of a faucet of Embodiment 2, when a cover is in a cover connection position.
Figure 13:
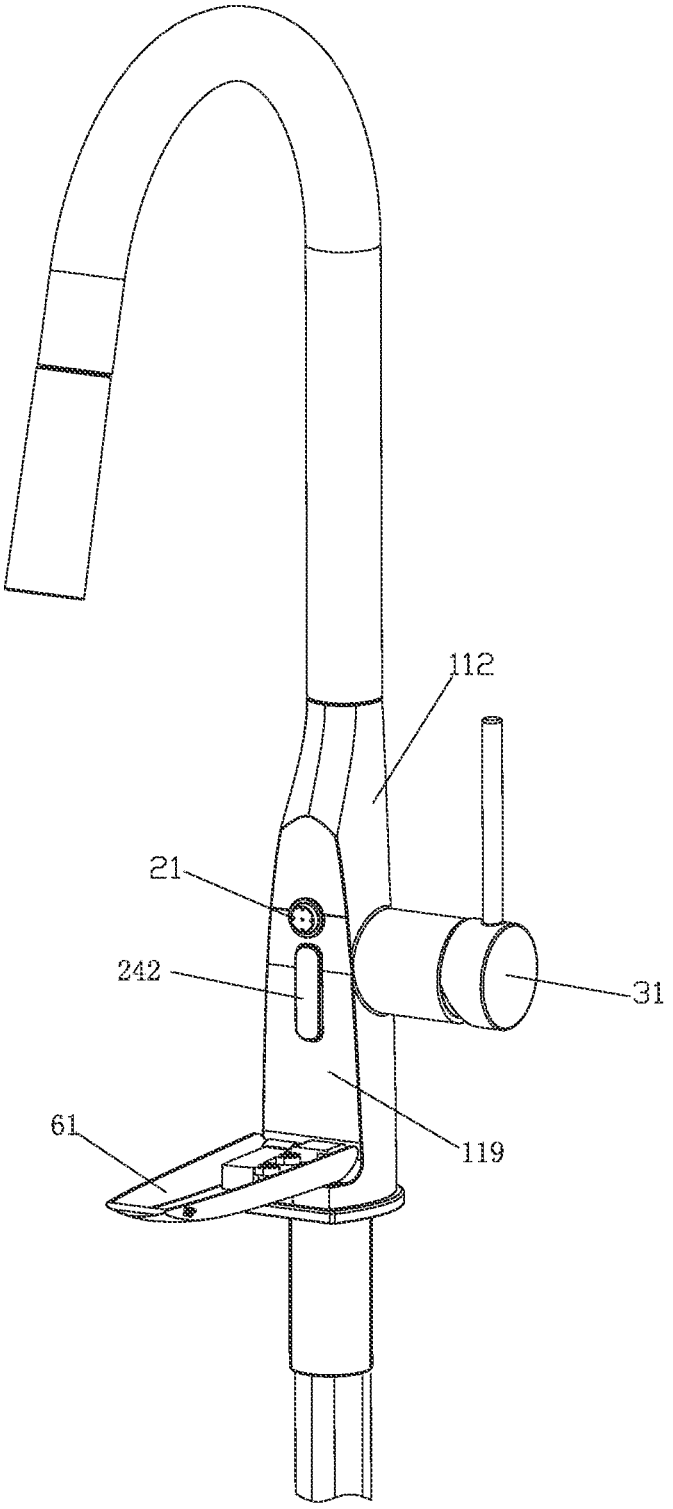
FIG. 13 illustrates a perspective view of the faucet of Embodiment 2, when the cover is in an open position.
Figure 14:
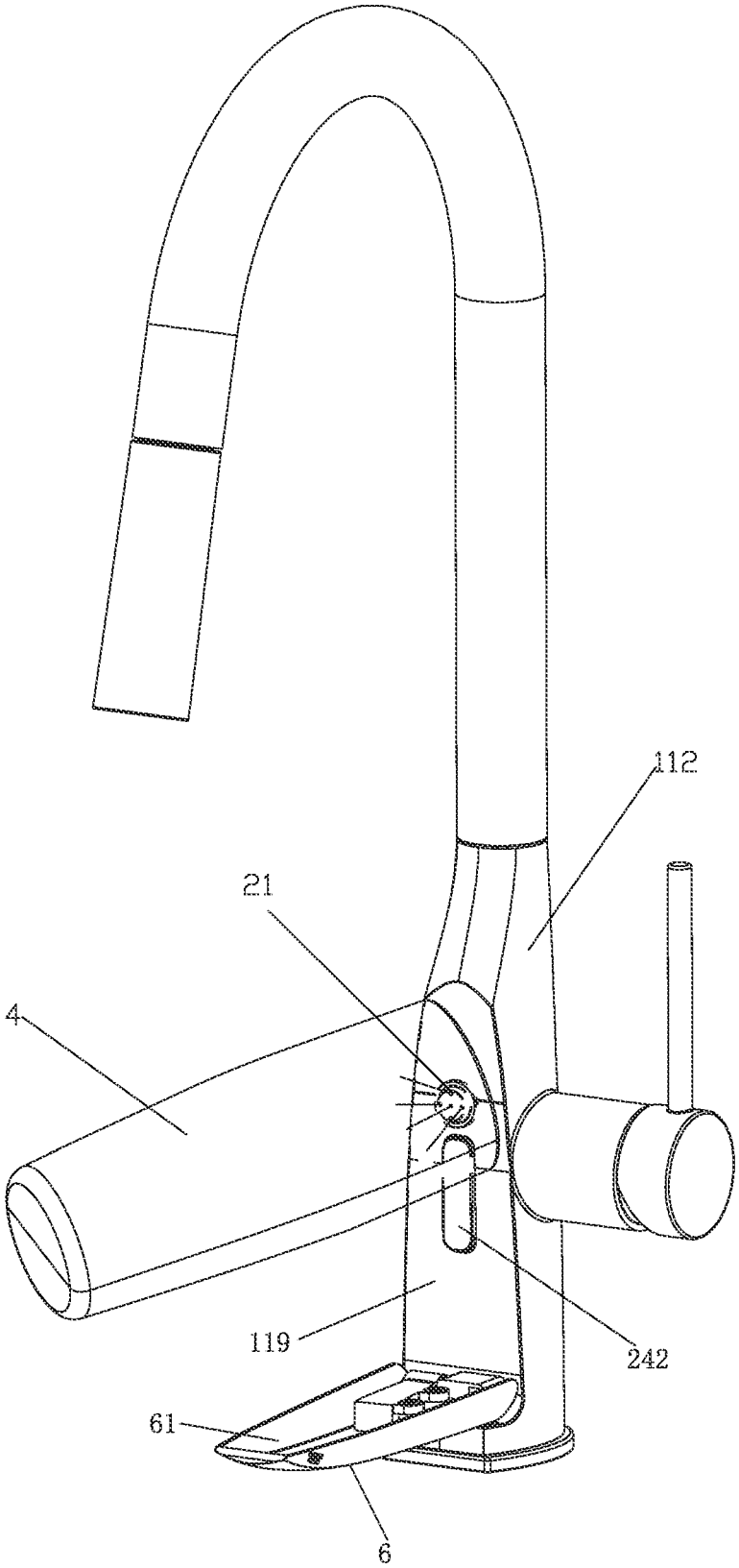
FIG. 14 illustrates a perspective view of a faucet mechanism and a utensil flushing mechanism of Embodiment 2, when a utensil is being flushed.

The difference between embodiment 2 and embodiment 1 is as follows. Referring to FIGS. 12-14, the utensil flushing mechanism 2 is fixedly connected to the tube body 11, and the utensil flushing mechanism 2 comprises the nozzle 21. A cover plate 6 is also provided. The cover plate 6 is rotatably connected to the tube body 11 and can move relative to the tube body 11 between an open position and a cover connection position, and through movement of the cover plate 6, the utensil flushing mechanism 2 is in a use state or a non-use state. When the cover plate 6 is in the open position, the utensil flushing mechanism 2 is in the use state, and when the cover plate 6 is in the cover connection position, the utensil flushing mechanism 2 is in the non-use state. The nozzle 21 of the utensil flushing mechanism 2, controlled by the cover plate 6 alternatively being in the open position or the cover connection position, is exposed to enable the utensil 4 to be cleaned by the nozzle 21 or hidden to enable the nozzle 21 to be protected from damage or contamination. In the specific structure, the tube body 11 comprises an installation surface 119, and the nozzle 21 is installed on the installation surface 119. The cover plate 6 forms a cover connection cavity 61, and the cover plate 6 is rotatably connected to the tube body 11. The cover plate 6 in the cover connection position covers the installation surface 119, and the cover connection cavity 61 covers the nozzle 21 with good concealment effect and beautiful appearance. The cover plate 6 in the open position is substantially arranged horizontally.

The installation surface 119 is disposed with the control switch 24 to control whether the nozzle 21 discharges water or not, and the cover plate 6 in the cover connection position covers the control switch 24, so as to avoid the control switch 24 from being touched by mistake. The control switch 24 can be pressed by an opening of the utensil 4 during use to turn on the second control valve 32.

Embodiment 3

The difference among Embodiment 3, Embodiment 1, and Embodiment 2 is as follows. The control box 5 is disposed with an ozone generator, and the ozone generator is disposed in the second water passage 14 so that the water sprayed by the nozzle 21 is ozone water to improve cleaning, disinfection, and sterilization effect.

Embodiment 4

Figure 15:
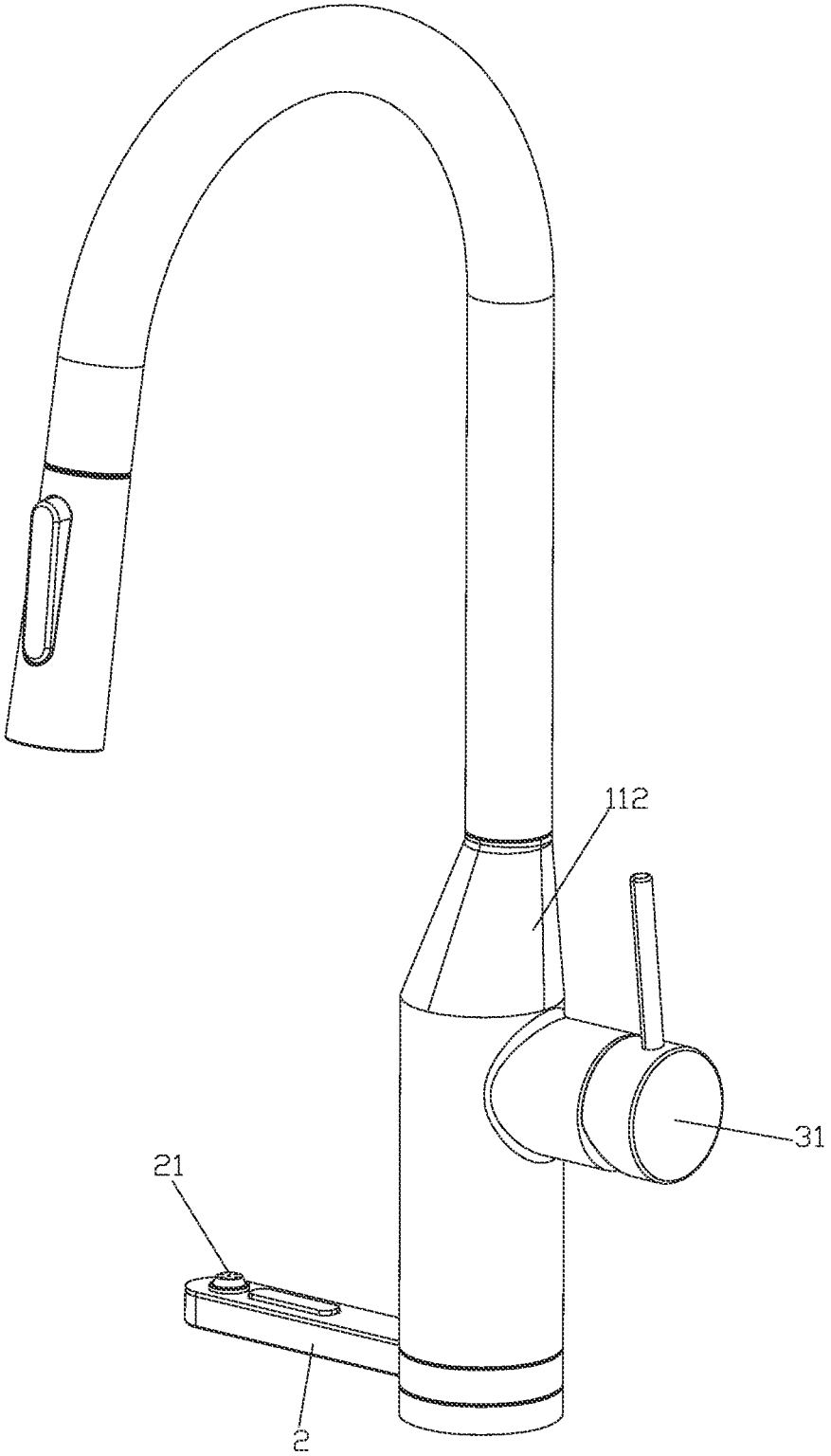
FIG. 15 illustrates a perspective view of a faucet of Embodiment 4, when a utensil flushing mechanism is in a use state.
Figure 16:
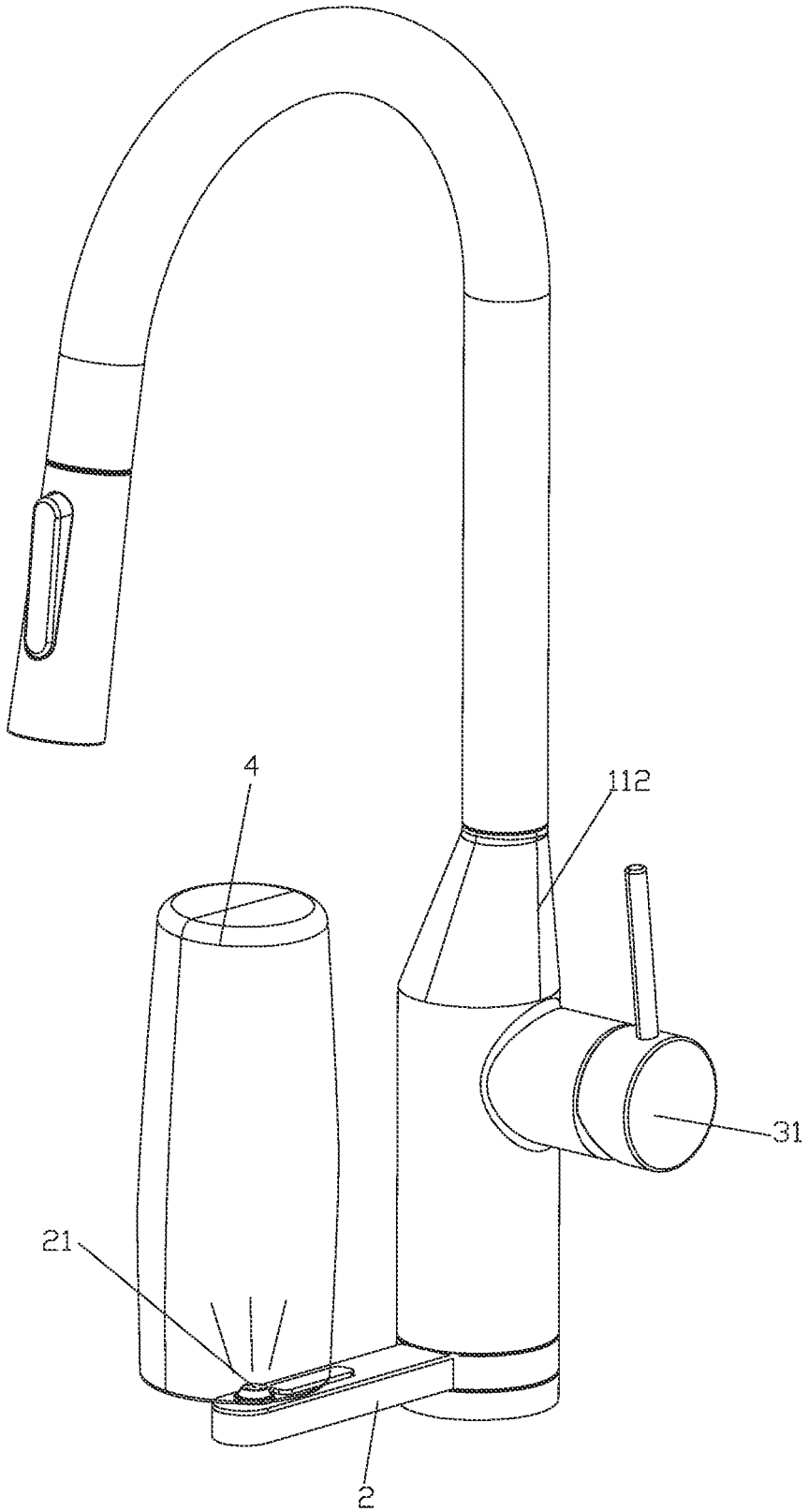
FIG. 16 illustrates a perspective view of the faucet of Embodiment 4, when a utensil is being flushed.

The difference between Embodiment 4 and Embodiment 2 is as follows. Referring to FIGS. 15-16, the utensil flushing mechanism 2 is rotatably connected to the tube body 11, the rotation axis of the utensil flushing mechanism 2 is parallel to a center line of the tube body 11, or the utensil flushing mechanism 2 and the tube body 11 are coaxially arranged. The utensil flushing mechanism 2 can be rotated around the tube body 11 in a circumferential direction of the tube body 11. The nozzle 21 of the utensil flushing mechanism 2 is in different positions through a rotation of the utensil flushing mechanism 2 to be controlled to be in the use position or the non-use position. The nozzle 21 in the non-use position will not interfere with other use states of the faucet or prevent the nozzle 21 from being contaminated. Referring to FIG. 15 and FIG. 16, in the non-use position, an included angle between the nozzle 21 and a water outlet positon is 90 degrees, and the nozzle 21 is rotated to an edge of a sink to avoid interfering with items being put into the sink.

The aforementioned embodiments are merely some embodiments of the present disclosure, and the scope of the disclosure is not limited thereto. Thus, it is intended that the present disclosure cover any modifications and variations of the presently presented embodiments provided they are made without departing from the appended claims and the specification of the present disclosure.

What is claimed is:

1. A faucet with a utensil flushing mechanism, comprising:

a faucet mechanism, a water inlet mechanism, and the utensil flushing mechanism, wherein:

the faucet mechanism comprises a tube body and a first water passage disposed at least partially in the tube body, the water inlet mechanism is connected to the first water passage, the utensil flushing mechanism comprises a nozzle configured to be in communication with the water inlet mechanism, the utensil flushing mechanism rotates about the tube body, a control switch is disposed on the utensil flushing mechanism, the control switch is configured to control whether water from the water inlet mechanism flows out of the nozzle, when the utensil flushing mechanism rotates to be in a use position, the nozzle and the control switch face an upward direction, and when a utensil is placed on the utensil flushing mechanism:

the control switch is touched by the utensil to be turned on, the utensil covers the nozzle, and the water flows out of the nozzle to clean the utensil.

2. The faucet with the utensil flushing mechanism according to claim 1, wherein:

a receiving groove is recessed on an outer peripheral wall of the tube body, and the utensil flushing mechanism is disposed in the receiving groove when in a non-use position.

3. The faucet with the utensil flushing mechanism according to claim 1, wherein:

a receiving groove is recessed on an outer peripheral wall of the tube body, the utensil flushing mechanism is disposed in the receiving groove when in a non-use position, a rotation axis of the utensil flushing mechanism is arranged horizontally and is disposed in the receiving groove, and a lower groove wall of the receiving groove is configured to inhibit movement of the utensil flushing mechanism when in the use position.

4. The faucet with the utensil flushing mechanism according to claim 3, wherein:

the tube body comprises a housing and a base fixedly connected under the housing, the housing is recessed to form the receiving groove, and the base forms the lower groove wall of the receiving groove.

5. The faucet with the utensil flushing mechanism according to claim 1, wherein:

the utensil flushing mechanism comprises a rotating shaft configured to be rotatably connected to the tube body, a first end face of the rotating shaft is recessed with an axial groove configured to be in communication with the water inlet mechanism along an axial direction of the rotating shaft, and the utensil flushing mechanism comprises a cup flushing water passage in communication with the nozzle and the axial groove.

6. The faucet with the utensil flushing mechanism according to claim 5, wherein:

the tube body comprises a mounting seat located thereon, a pivoting shaft protrudes from the mounting seat, the mounting seat comprises a water inlet groove, a distal end face of the pivoting shaft is recessed with a water outlet groove in communication with the water inlet groove, the pivoting shaft is rotatably disposed in the axial groove, and the water outlet groove is in communication with the axial groove.

7. The faucet with the utensil flushing mechanism according to claim 6, wherein:

the tube body comprises a lug, the lug comprises a pivoting hole, the lug and the mounting seat face each other, and a second end of the pivoting shaft is rotatably connected in the pivoting hole of the lug.

8. The faucet with the utensil flushing mechanism according to claim 1, wherein:

the faucet further comprises a first control valve connected between the water inlet mechanism and the utensil flushing mechanism and configured to at least control an opening and closing of the utensil flushing mechanism, the utensil flushing mechanism comprises a water outlet body, the nozzle is disposed on the water outlet body, and the control switch is in communication with the first control valve.

9. The faucet with the utensil flushing mechanism according to claim 8, wherein:

the control switch is a touch switch, a top surface of the utensil flushing mechanism is disposed with the touch switch when in the use position, and the touch switch is controlled by whether the utensil is placed on the utensil flushing mechanism.

10. The faucet with the utensil flushing mechanism according to claim 8, wherein:

the utensil flushing mechanism further comprises a lower casing and a panel, the water outlet body comprises a rotating shaft configured to be rotatably connected to the tube body, a first end face of the rotating shaft is recessed with an axial groove configured to be in communication with the water inlet mechanism along an axial direction of the rotating shaft, the water outlet body comprises a cup flushing water passage in communication with the axial groove and a through opening in communication with the cup flushing water passage, the through opening is disposed with the nozzle, the water outlet body is fixedly disposed in the lower casing, the panel fixedly covers and is connected to the lower casing, and the panel comprises a position-providing opening corresponding to the nozzle and the control switch.

11. The faucet with the utensil flushing mechanism according to claim 1, wherein:

the water inlet mechanism comprises a cold water passage and a hot water passage, the utensil flushing mechanism is connected to the cold water passage of the water inlet mechanism, the faucet mechanism comprises a first control valve, the first control valve is in communication with the cold water passage, the hot water passage, and the first water passage, and the first control valve is disposed on the tube body.

12. The faucet with the utensil flushing mechanism according to claim 11, wherein:

the faucet further comprises a second control valve connected between the water inlet mechanism and the utensil flushing mechanism and configured to at least control an opening and closing of the utensil flushing mechanism, the faucet mechanism comprises a supporting pipe and a second water passage, a first end of the first water passage is in communication with the first control valve, a second end of the first water passage passes through the tube body and the supporting pipe, the first control valve is in communication with the cold water passage and a first end of the second water passage, and a second end of the second water passage is configured to be in communication with the nozzle.

13. A faucet with a utensil flushing mechanism, comprising:

a faucet mechanism, a water inlet mechanism, and the utensil flushing mechanism, wherein:

the faucet mechanism comprises a tube body and a first water passage disposed at least partially in the tube body, the water inlet mechanism is connected to the first water passage, the utensil flushing mechanism is movably disposed on the tube body and is configured to rotate about the tube body between a use position and a non-use position, a receiving groove is recessed on an outer peripheral wall of the tube body, the utensil flushing mechanism is disposed in the receiving groove when in the non-use position, a nozzle configured to be in communication with the water inlet mechanism and a control switch are disposed on the utensil flushing mechanism, the control switch is configured to control whether water from the water inlet mechanism flows out of the nozzle, when the utensil flushing mechanism rotates to be in the use position, the nozzle and the control switch face an upward direction, when the utensil flushing mechanism rotates to be in the non-use position, the nozzle and the control switch face a direction differing from the upward direction, and when a utensil is placed on the utensil flushing mechanism:

the control switch is touched by the utensil to be turned on, the utensil covers the nozzle, and the water flows out of the nozzle to clean the utensil.

14. A faucet with a utensil flushing mechanism, comprising:

a faucet mechanism, a water inlet mechanism, and the utensil flushing mechanism, wherein:

the faucet mechanism comprises a tube body and a first water passage disposed at least partially in the tube body, the water inlet mechanism is connected to the first water passage, the utensil flushing mechanism comprises a nozzle configured to be in communication with the water inlet mechanism, the utensil flushing mechanism is disposed on the faucet mechanism and is configured to rotate about the tube body to be controlled to be alternatively in a use state or a non-use state, the nozzle of the utensil flushing mechanism is exposed when in the use state, the nozzle of the utensil flushing mechanism is hidden when in the non-use state, a control switch is disposed on the utensil flushing mechanism, the control switch is configured to control whether water from the water inlet mechanism flows out of the nozzle, when the utensil flushing mechanism rotates to be in the use state, the nozzle and the control switch are in a use position, when the utensil flushing mechanism rotates to be in the non-use state, the nozzle and the control switch are in a position differing from the use position, and when a utensil is placed on the utensil flushing mechanism:

the control switch is touched by the utensil to be turned on, the utensil covers the nozzle, and the water flows out of the nozzle to clean the utensil.

15. The faucet with the utensil flushing mechanism according to claim 14, wherein:

the utensil flushing mechanism is movably disposed on the tube body, and the utensil flushing mechanism is configured to move relative to the tube body between the use position and a non-use position.

16. The faucet with the utensil flushing mechanism according to claim 14, wherein:

the faucet further comprises a cover plate movably connected to the tube body, the cover plate is configured to move relative to the tube body between a cover connection position, at which the cover plate at least covers the nozzle, and an open position, at which the cover plate does not cover the nozzle, and the utensil flushing mechanism is configured to be controlled to be alternatively in the use state or the non-use state through movement of the cover plate.

17. The faucet with the utensil flushing mechanism according to claim 1, wherein:

a rotation axis of the utensil flushing mechanism is parallel to a center line of the tube body.

18. The faucet with the utensil flushing mechanism according to claim 1, wherein:

the utensil flushing mechanism and the tube body are coaxially arranged, the utensil flushing mechanism is configured to be rotated around the tube body in a circumferential direction of the tube body, and the nozzle of the utensil flushing mechanism is in different positions through a rotation of the utensil flushing mechanism.

19. The faucet with the utensil flushing mechanism according to claim 1, wherein:

the nozzle in a non-use position will not interfere with other use states of the faucet or prevent the nozzle from contaminant.

20. The faucet with the utensil flushing mechanism according to claim 19, wherein:

when the nozzle in the non-use position, an included angle between the nozzle and a water outlet position is 90 degrees, and the nozzle is rotated to an edge of a sink to avoid interfering with items being put into the sink.

* * * * *